US005332222A

United States Patent [19]

Perry

[11] Patent Number: 5,332,222

[45] Date of Patent: Jul. 26, 1994

[54] GOLF CLUB INCLUDING PUTTING PATH CLEANING MEANS

[75] Inventor: Daniel A. Perry, Macon, Ga.

[73] Assignee: The Dash Corporation, Macon, Ga.

[21] Appl. No.: 67,047

[22] Filed: May 25, 1993

[51] Int. Cl.[5] ..... A63B 69/36; A63B 53/00; A47L 5/14

[52] U.S. Cl. ..... 273/162 F; 15/344; 15/339; 15/405

[58] Field of Search ..... 273/32 B, 162 R, 162 F; 15/405, 406, 339, 344, 4

[56] References Cited

U.S. PATENT DOCUMENTS 3,189,934 6/1965 Steinwedel ..... 15/406

3,999,243 12/1976 La Pour ..... 273/32 B X 4,063,317 12/1977 Santore ..... 15/406 X

*Primary Examiner*—George J. Marlo

*Attorney, Agent, or Firm*—Deveau, Colton & Marquis

[57] ABSTRACT

An apparatus for cleaning a golf putting path including a hand grip portion, an elongate shaft secured to the hand grip portion, and a head secured to an opposite end of the shaft. The hand grip, shaft, and head are collectively sized and arranged to resemble a golf club and further they include a compressed gas cartridge, a discharge nozzle, and a valve in fluid communication with the compressed gas cartridge and the discharge nozzle for controlling flow of gas from the compressed gas cartridge to the discharge nozzle.

11 Claims, 3 Drawing Sheets

GOLF CLUB INCLUDING PUTTING PATH CLEANING MEANS

TECHNICAL FIELD

The present invention relates to golf equipment and more particularly relates to a device for clearing a putting path of small debris.

BACKGROUND OF THE INVENTION

In golf, it frequently occurs that small debris lies in the putting path of the golf ball, between the golf ball on the green and the hole. Such debris often is in the form of dirt, sand, clipped grass blades, twigs, leaves, and other such small items. Such debris can slightly deflect the ball as it is putted toward the hole, thereby interfering with the golfer's efforts to putt the ball into the hole. Even small deflections in the trajectory of the putt can make the difference between a made shot and a missed shot.

One way of clearing the path of such debris is simply to bend down and pick it up with one's fingers. Obviously, this has the disadvantage of requiring much bending or stooping. Also, this requires direct physical contact with the debris, which may or may not be permitted under certain rules of play.

Accordingly, a need yet remains for a convenient means for clearing or cleaning a golf putting path of debris which does not require bending or stooping in order to effect such clearing and which also does not require that the golfer physically touch the debris. It is to the provision of such that the present invention is primarily directed.

SUMMARY OF THE INVENTION

In a preferred form, the present invention comprises an apparatus for cleaning a golf putting path and includes a handgrip portion and an elongate shaft having a first end and a second end opposite the first end. The first end of the elongate shaft is secured to and extends from one end of the handgrip portion. A head is secured to the second end of the shaft and extends generally transverse thereto and includes a gas discharge nozzle. Preferably, the handgrip portion, the shaft, and the head collectively are sized and arranged to generally resemble a golf club.

A compressed gas storage means is provided for supplying compressed gas to the gas discharge nozzle. The compressed gas storage means is provided in conjunction with a valve means in fluid communication with the compressed gas storage means. The valve means also is in fluid communication with the gas discharge nozzle for controlling flow of gas from the compressed gas storage means to the gas discharge nozzle.

With this arrangement, the valve means can be operated to provide a small blast of compressed air out through the gas discharge nozzle for cleaning the putting path. The apparatus being shaped like a golf club allows the debris to be blown from the putting path without stooping or bending. Also, the blast of air allows such to be effected without direct human contact with the debris.

Preferably, the valve means comprises a trigger positioned in the bottom of the head so that the head can be simply touched to the ground to discharge a blast of air. Also, the compressed gas storage means preferably comprises a bottle removably positioned in the handgrip for easy replacement. Such a bottle can take the form of conventional $CO_2$ cartridges, as are widely available for use in small handguns (e.g., pellet guns).

Accordingly, it is a primary object of the present invention to provide an apparatus for clearing a putting path, which apparatus is easily operated, effective in use, and rugged in construction.

It is another object of the present invention to provide an apparatus for cleaning a golf putting path which is constructed of few parts and is economical in manufacture.

It is another object of the present invention to provide an apparatus for cleaning a golf putting path which allows the putting path to be cleared without requiring that the golfer bend or stoop.

It is yet a further object of the present invention to provide an apparatus for clearing a golf putting path which allows the golfer to clear the putting path without requiring direct human contact with the debris in the path.

It is a further object of the present invention to provide an apparatus for clearing a golf putting path which is easy and economical to maintain in operation.

These and other objects, features, and advantages of the present invention will become apparent to those skilled in the art upon reading the following specification in conjunction with the accompanying drawing figures.

BRIEF DESCRIPTION OF THE DRAWING FIGURES

Figure 2:
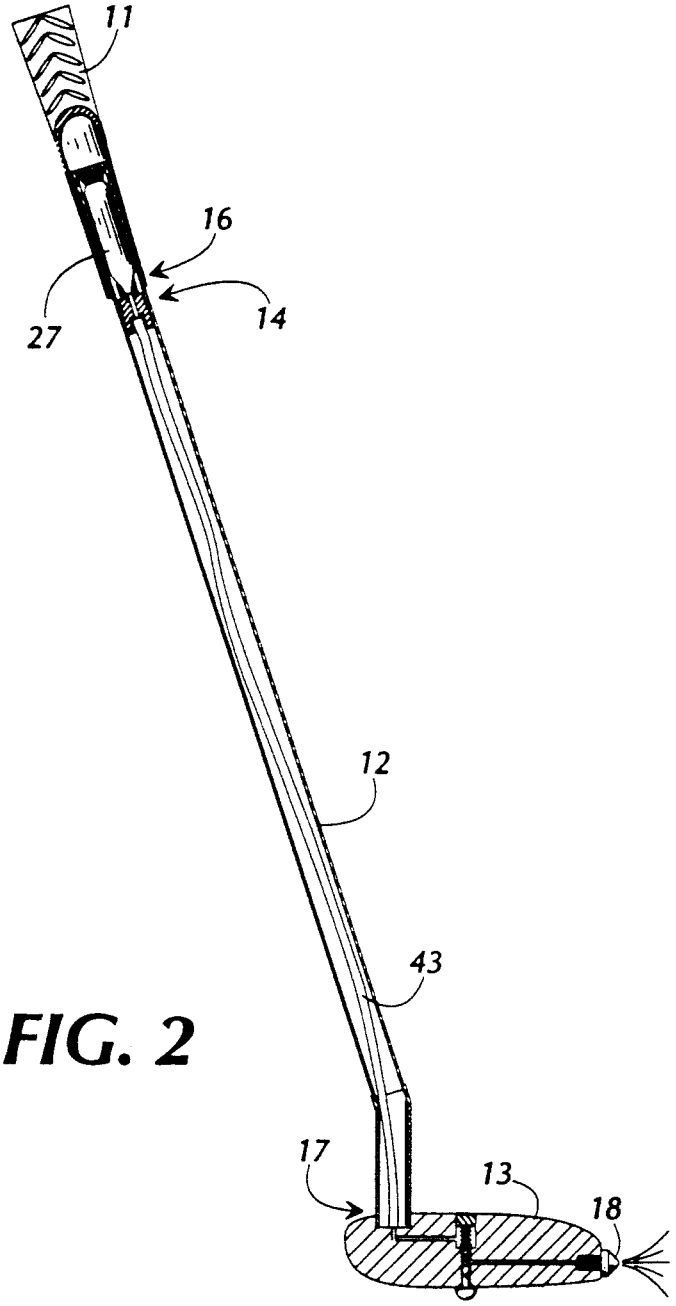
FIG. 2 is a schematic, sectional illustration of the apparatus of FIG. 1.
Figure 4:
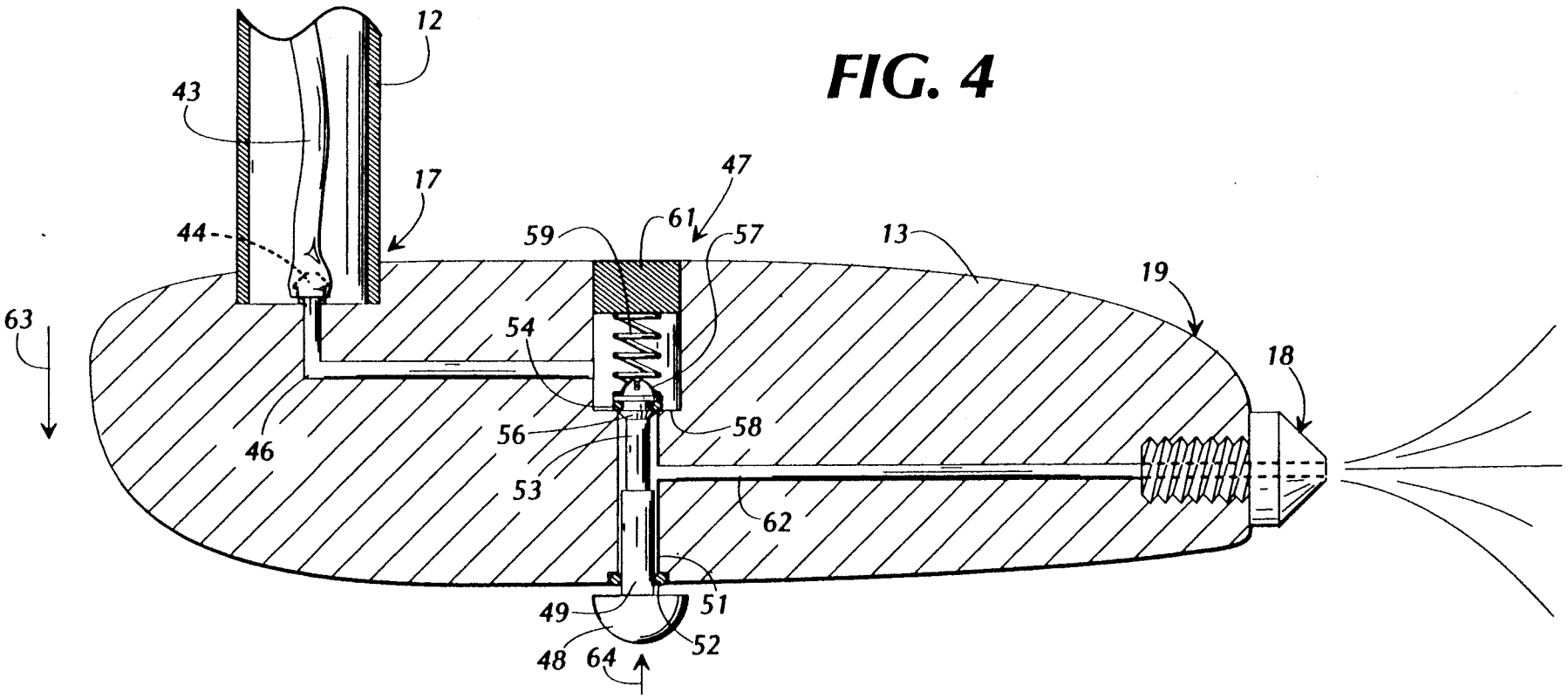

FIG. 4. is a sectional illustration of another portion of the apparatus of FIG. 2, also showing greater detail.

DETAILED DESCRIPTION OF THE PREFERRED EMBODIMENT

Figure 1:
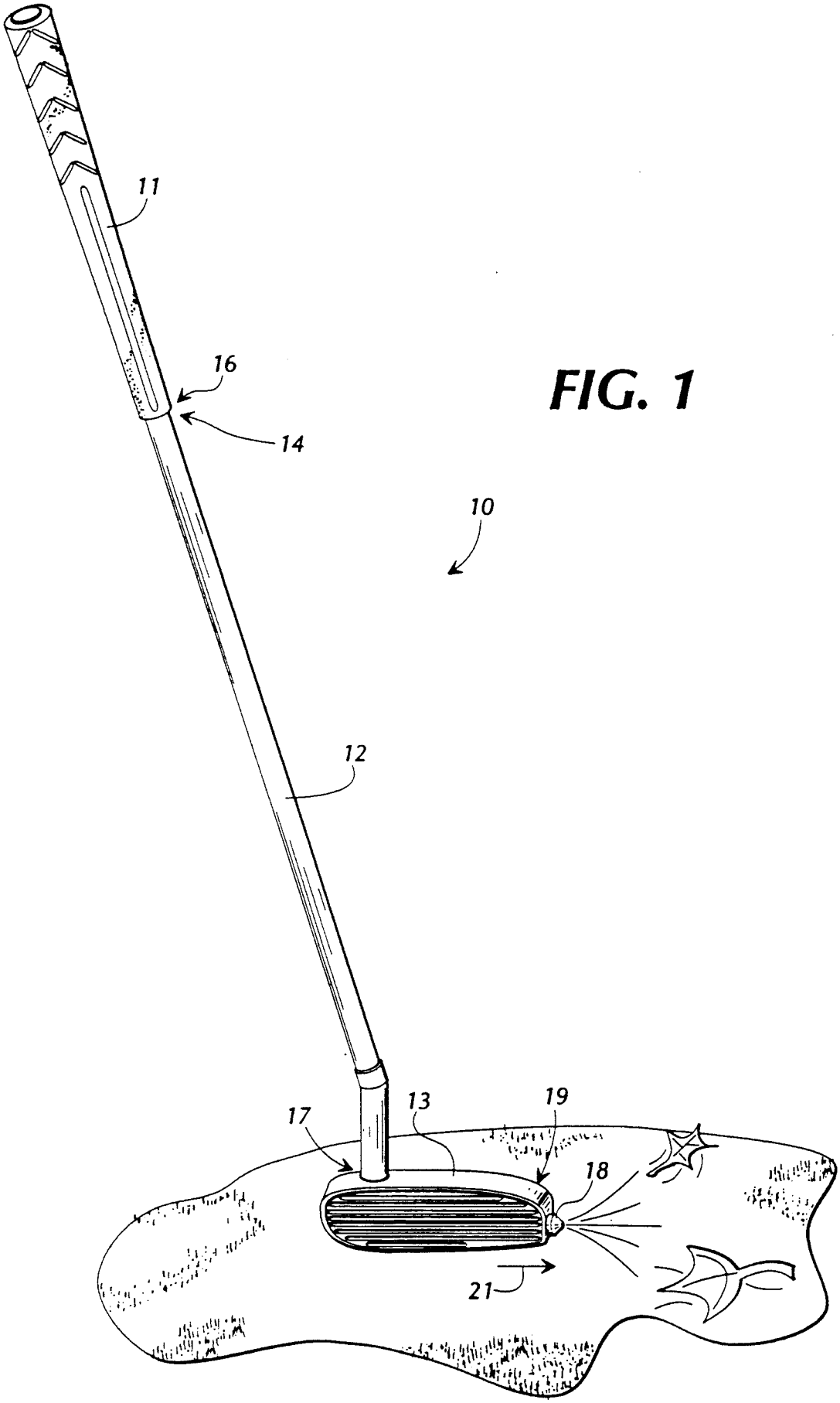
FIG. 1 is a perspective illustration of an apparatus according to a preferred form of the invention.

Referring now in detail to the drawing figures, wherein like reference numerals represent like parts throughout the several views, FIG. 1 shows an apparatus 10 for cleaning a golf putting path including a hand grip portion or handle 11, an elongate shaft 12, and a head 13. An upper end 14 of shaft 12 is secured to a lower end 16 of hand grip 11. A lower end 17 of shaft 12 is secured to the head 13. Collectively, the hand grip, the shaft, and the head are sized and arranged to generally resemble a conventional golf club, such as a putter as depicted in FIG. 1. The head 13 can be cast in or machined of metal, molded of plastic, or made from another suitable material, as desired. Also, the shaft 12 can be made of materials as conventionally used in typical golf clubs.

As shown in FIG. 1, the head 13 includes a gas discharge nozzle 18 mounted at a first end 19 distal from the shaft 12 in head 13. The gas discharge nozzle 18 is oriented to generally direct a blast of air in the direction of direction arrow 21, generally away from the lower portion 17 of the shaft 12. The blast of air that emanates from the gas discharge nozzle 18 of course has some spread, as is schematically depicted in FIG. 1.

Figure 3:
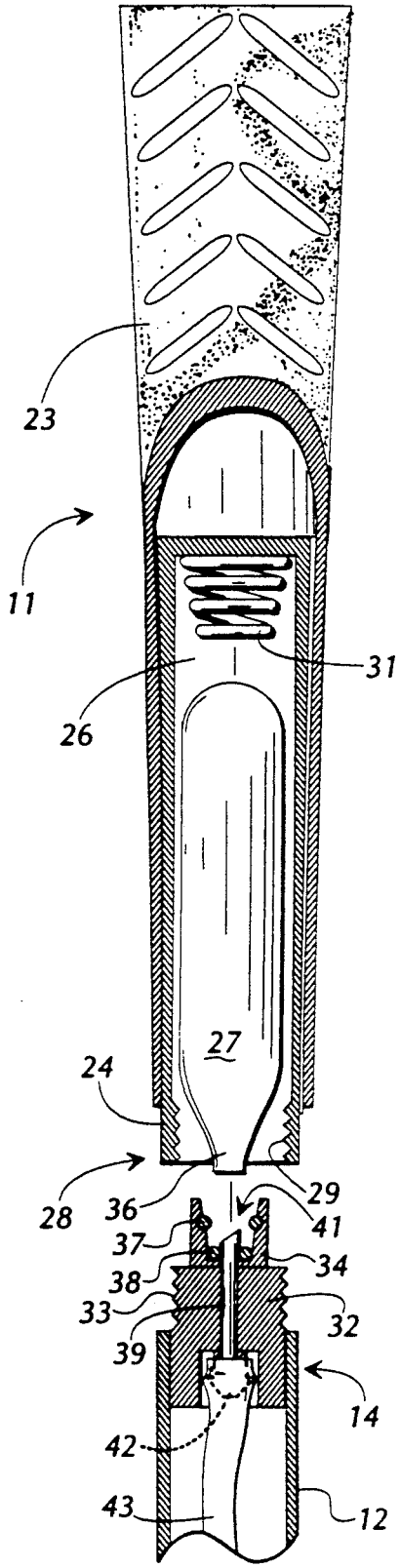
FIG. 3 is a sectional illustration of a portion of the apparatus of FIG. 2, showing greater detail.

Referring now to FIGS. 2–4, the hand grip 11 can be seen to include an external rubber grip 23 which is snugly-fitted about a metal or rigid plastic elongate cap 24 which defines a hollow interior chamber 26 for receiving a standard $CO_2$ (carbon dioxide) cartridge 27. A lower end 28 of the cap 24 includes female threads 29. A compression spring 31 is mounted in the top of the metal cap 24 between the metal cap and the $CO_2$ cartridge 27.

FIG. 3 also shows an upper end 14 of the shaft 12 in greater detail. A plug 32 is shown pressed in or otherwise permanently mounted in the upper end 14 of the hollow shaft 12. The lower end of the plug 32 depicted is smooth, as is the interior of the upper end 14 of the shaft 12. Alternatively, both the lower end of the plug 32 and the interior wall of the upper end 14 of the shaft 12 could be threaded for mounting. What is important is that the mounting of the plug to the upper end 14 be relatively secure. The plug 32 includes upper male threads 33 for threadedly receiving the female threads 32 in the hand grip 11. Alternately, instead of male and female threads, a bayonet-style connection can be provided. Plug 32 includes a coupling portion 34 for receiving a neck portion 36 of the $CO_2$ cartridge 27. The coupling 34 defines a roughly frustoconical open region bearing first and second O-ring seals 37 and 38. A piercing connecting pipe 39 extends upwardly through the plug 32 and has a beveled piercing end indicated at 41 for puncturing or piercing the seal in the end of the neck 36 of the $CO_2$ cartridge 27. The opposite end or lower end 42 of the connecting pipe 39 is barbed or flared for receiving a flexible plastic pipe 43 and securing same thereto. As shown in FIG. 2, the plastic pipe 43 extends lengthwise from the upper end portion 14 of the shaft 12 to the lower end portion 17 of shaft 12 to connect with the head 13. As shown in FIG. 4, the plastic pipe 43 slips over a barb or flared pipe 44 formed in or secured to the head 13. The barbed pipe 44 is hollow for communicating the interior of the plastic pipe 43 with internal passageway 46 formed in the head 13.

The internal passageway 46 connects the plastic pipe 43 with a valve assembly generally indicated at 47. The valve assembly 47 includes a trigger or button 48 mounted to a shaft 49 which closely corresponds in diameter to a bore 51 that the shaft rides in. An O-ring seal 52 seals the shaft at the end of the bore. The shaft 49 includes an upper portion 53 which is of a reduced diameter for allowing flow of gas therepast. An O-ring seal 54 is mounted to the upper portion 53 of shaft 49 between a beveled shoulder portion 56 and a screw and washer combination 57. The O-ring seal is effective for sealing against a shoulder or valve seat 58. A compression spring 59 is fitted between the screw and washer combination 57 and a plug 61. Operation of the trigger 48 moves the valve upwardly against the force of the compression spring 59 to allow fluid communication between internal passageway 46 and internal passageway 62, with internal passageway 62 being in fluid communication with gas discharge nozzle 18.

OPERATION

To prepare the apparatus for use, one unscrews the hand grip portion 11 from the shaft 12 and inserts a new $CO_2$ cartridge 27. Then the hand grip portion 11 is threaded back onto the shaft 12 which causes the beveled end 41 of the piercing connecting pipe 39 to pierce and penetrate the seal in the end of the neck 36 of the $CO_2$ cartridge 27, causing gas to discharge from the $CO_2$ cartridge into the plastic pipe 43 where it is communicated through the shaft 12 to the valve assembly 47. The apparatus then is ready for use.

To use the apparatus to clear debris from the putting path, one holds the apparatus upright and gently taps or rests it on the ground to operate the trigger 48. This downward movement of the club head in the direction of direction arrow 63 causes the trigger button 48 to move upwardly in the direction of direction arrow 64 when the trigger button 48 contacts a horizontal surface, such as the ground. Upward movement of the trigger button 64 causes the valve assembly 47 to open, allowing gas to flow from the plastic pipe 43 to the discharge nozzle 18. By aiming the club head toward the debris prior to tapping or tamping the club head on the ground to operate the valve, debris can be easily and quickly cleared from the putting path, as depicted in FIG. 1.

After a number of uses clearing debris, the effective gas supply in the $CO_2$ cartridge is consumed and the hand grip 11 is removed to replace the $CO_2$ cartridge 27.

Thus, it is seen that a highly effective, yet mechanically simple, apparatus is provided for clearing a putting path of debris. Of course, it is possible to modify the apparatus disclosed herein as the preferred form of the invention. For example, while the valve assembly is shown mounted in an underside portion of the head 13, the valve assembly can be modified and placed elsewhere in the apparatus. For example, a valve can be placed in or near the handle. Also, it is possible to place the $CO_2$ cartridge in the club head and do away with the lengthy connecting pipe 43.

Moreover, it is possible to add a trigger lock to prevent the trigger 48 from being inadvertently depressed while in a golf bag. Such a trigger lock can take the form of a simple pivoting arm that can pivot between a first position where at least part of the arm is positioned between the trigger 48 and head 13 and a second position where it is swung completely out of the way.

To make the apparatus more useful as an actual putter, one can relocate the trigger 48 from the head 13 to the hand grip 11 or the shaft 12. Conversely, one can construct head 13 to not resemble a club head so that it is clear that the apparatus is not actually a golf club, if such is desired.

While the invention has been disclosed in a preferred form only, it will be readily apparent to those skilled in the art that many modifications, additions, and deletions can be made therein without departing from the spirit and scope of the invention as set forth in the appended claims.

What is claimed is:

1. A golf club for use with a compressed gas cartridge for clearing a golf putting path comprising:
   - a hollow handle for housing the compressed gas cartridge;
   - a tubular shaft having first and second ends and releasably secured to said hollow handle at said first end;
   - a club head secured to said second end of said tubular shaft and having a ball striking face;
   - a discharge nozzle mounted to said club head; and
   - valve means in fluid communication with the compressed gas cartridge and said discharge nozzle for controlling the flow of compressed gas from the compressed gas cartridge to said discharge nozzle, said valve means comprising a trigger positioned adjacent an underside portion of said club head.

2. A golf club as claimed in claim 1 wherein said discharge nozzle is oriented to discharge gas along a direction parallel to said ball striking face and away from said tubular shaft.

3. A golf club as claimed in claim 1 wherein said tubular shaft is threadedly secured to said hollow handle for replaceably positioning the compressed gas cartridge within said hollow handle.

4. A golf club including apparatus for cleaning a golf putting path and comprising;

a hand grip portion;

an elongate shaft having a first end and a second end opposite said first end, said first end of said elongate shaft being secured to said hand grip portion and extending from one end of said hand grip portion;

a club head having a ball striking face and secured to said second end of said shaft and extending generally transverse thereto and comprising a gas discharge nozzle for discharging gas for cleaning the putting path;

compressed gas storage means for storing compressed gas for supplying gas to said gas discharge nozzle; and valve means in fluid communication with said compressed gas storage means and said gas discharge nozzle for controlling the flow of gas from said compressed gas storage means to said gas discharge nozzle.

5. A golf club as claimed in claim 4 wherein said valve means comprises a trigger positioned adjacent an underside portion of said club head for operation by engagement with a horizontal surface.

6. A golf club as claimed in claim 4 wherein said gas discharge nozzle is positioned at a distal end of said club head, relative to said elongate shaft, and is generally oriented away from said elongate shaft.

7. A golf club as claimed in claim 4 wherein said hand grip portion is releasably secured to said elongate shaft.

8. A golf club as claimed in claim 4 wherein said hand grip portion is threadedly secured to said elongate shaft.

9. A golf club as claimed in claim 4 wherein said storage means is removably contained within said hand grip portion.

10. A golf club as claimed in claim 9 further comprising an elongate tube extending between said compressed gas storage means and said valve means for delivering gas from said compressed gas storage means to said valve means, said tube being fitted within said elongate shaft.

11. A golf club as claimed in claim 10 wherein said valve means is mounted in said club head and comprises trigger means mounted adjacent an underside portion of said club head.

* * * * *